US011533974B2

(12) United States Patent
Robinault et al.

(10) Patent No.: US 11,533,974 B2
(45) Date of Patent: Dec. 27, 2022

(54) HAIR TREATMENT SYSTEM

(71) Applicant: L'OREAL, Paris (FR)

(72) Inventors: Jean-Luc Robinault, Saint-Ouen (FR); Henri Samain, Chevilly Larue (FR)

(73) Assignee: L'OREAL, Paris (FR)

( * ) Notice: Subject to any disclaimer, the term of this patent is extended or adjusted under 35 U.S.C. 154(b) by 286 days.

(21) Appl. No.: 16/626,007

(22) PCT Filed: Jun. 22, 2018

(86) PCT No.: PCT/EP2018/066727

§ 371 (c)(1),
(2) Date: Dec. 23, 2019

(87) PCT Pub. No.: WO2019/002117

PCT Pub. Date: Jan. 3, 2019

(65) Prior Publication Data

US 2021/0153619 A1 May 27, 2021

(30) Foreign Application Priority Data

Jun. 30, 2017 (FR) ..... 1756117

(51) Int. Cl.
*A45D 19/00* (2006.01)
*A46B 11/06* (2006.01)
(Continued)

(52) U.S. Cl.
CPC ..... *A45D 19/005* (2021.01); *A46B 11/066* (2013.01); *B01F 23/451* (2022.01); *B01F 35/711* (2022.01); *B01F 2101/21* (2022.01)

(58) Field of Classification Search
CPC .. A45D 19/00; A45D 19/005; A45D 19/0041; B01F 23/451; B01F 35/711; A46B 11/06; A46B 11/063; A46B 11/066
See application file for complete search history.

(56) References Cited

U.S. PATENT DOCUMENTS 3,653,376 A 4/1972 Martin
2006/0257345 A1* 11/2006 Maillefer ..... A61K 8/046 424/70.7
(Continued)

FOREIGN PATENT DOCUMENTS

CN 105395115 12/2017
EP 1068816 A1 1/2001
(Continued)

OTHER PUBLICATIONS

Notice of Reasons for Refusal JP Pat. App. No. 2019-572509 dated Sep. 30, 2021 (6 pages).
(Continued)

*Primary Examiner* — J C Jacyna
(74) *Attorney, Agent, or Firm* — Shumaker, Loop & Kendrick, LLP

(57) ABSTRACT

System for treating a head of hair, including a pipe for circulating a liquid, a device for feeding the pipe with water, at least one source of product, the product (P1) comprising one or more surfactants, a device for injecting product into the pipe to form a treatment solution comprising one or more surfactants in a content ranging from 0.35% to 1.5% by weight of surfactant(s) relative to the total weight of the treatment solution, a dispensing device for delivering the treatment solution onto the head of hair (B) with a flow rate of between 0.5 and 5 L/min, better still between 0.8 and 3 L/min.

16 Claims, 1 Drawing Sheet

(51) Int. Cl.

| | |
|---|---|
| ***B01F 23/451*** | (2022.01) |
| ***B01F 35/71*** | (2022.01) |
| *B01F 101/21* | (2022.01) |

(56) References Cited

U.S. PATENT DOCUMENTS

| | | | | |
|---|---|---|---|---|
| 2008/0267897 | A1 | 10/2008 | Giroud et al. | |
| 2013/0160786 | A1* | 6/2013 | Fujioka | A45D 44/10 132/200 |
| 2017/0051480 | A1* | 2/2017 | Farcet | B05B 7/0093 |

FOREIGN PATENT DOCUMENTS

| | | | |
|---|---|---|---|
| EP | 2620077 | A1 | 7/2013 |
| JP | 2003033219 | A | 2/2003 |
| WO | 2015/165940 | A1 | 11/2015 |

OTHER PUBLICATIONS

International Search Report (ISR) for PCT/EP2018/066727 dated Jul. 13, 2018 (4 pages).
Written Opinion of the International Searching Authority for PCT/EP2018/066727 dated Jul. 13, 2018 (9 pages).
English Translation of Office Action for Japanese Pat. Application No. 2019-572509, dated May 10, 2021 (3 pages).

* cited by examiner

HAIR TREATMENT SYSTEM

The present invention relates to the field of washing, especially washing the hair, and more particularly, but not exclusively, to that of shampoo washes performed in salons.

BACKGROUND

Hair washing systems generally use an amount of water that is much greater than needed to obtain satisfactory washing.

There is thus a need to have a system for using an adequate amount of water, especially for the sake of respect for the environment.

Systems delivering a small amount of water exist. Some of them reduce the flow of water, until a flow of between 8 L/min and 4 L/min is obtained, by reducing the diameter of the outlet orifice. To limit the user's sensation of having an insufficient amount of water, these solutions use an air inlet in the water stream.

It is possible to further reduce the flow of water, then going down to flow rates of 2 L/min or less. With such flow rates, it is possible to wet the hair, but it becomes very difficult to rinse the hair after applying the shampoo, since the water drops do not penetrate the head of hair. They tend to slide on the surface of the head of hair, and do not rinse the interior of the head of hair.

It is also possible to reduce the flow of water and to accelerate the water drops. A system for reducing the flow rate but increasing the pressure is used to do this. The drops may then strike the scalp, giving an unpleasant sensation.

This sensation may be decreased by using a special nozzle which decreases the size of the drops. A jet with a low flow rate (2 L/min or less) is then obtained, with drops which penetrate the surface of the head of hair. However, the speed of the drops causes the shampoo present on the hair to lather. Whereas it would be desired to rinse out the lather, rinsing increases the abundance of lather, which considerably lengthens the time required for this operation.

Thus, with or without pressurization, rinsing still takes very long to perform. A head of hair with natural hairs 30 cm long, of normal abundance, takes about 3 minutes to rinse instead of 30 seconds.

The water saving balance is, admittedly, still positive, but the difference is relatively small. The system is unacceptable due to the considerable time loss it imposes on the user.

There is thus a need to further improve the systems that make it possible especially to wash the hair while affording savings in water, so as to make them faster without losing in efficiency.

SUMMARY

The invention meets this need with the aid of a hair treatment system comprising:

- a pipe for circulating a liquid,
- a device for feeding the pipe with water,
- at least one source of product comprising one or more surfactants,
- a device for injecting product into the pipe to form a treatment solution comprising one or more surfactants in a content ranging from 0.35% to 1.5% by weight of surfactant(s) relative to the total weight of the treatment solution, and preferentially from 0.6% to 1.2% by weight relative to the total weight of the treatment solution,

- a dispensing device for delivering the treatment solution onto the head of hair with a flow rate of between 0.5 and 5 L/min, better still between 0.8 and 3 L/min.

Such characteristics in terms of flow rate and of amount of surfactant(s) make it possible to wash and rinse the hair correctly and rapidly.

The relatively low amount of surfactant(s) limits the formation of lather on the hair during rinsing, and enables fast and efficient rinsing at a low flow rate.

Such a device can afford savings in water, product and also time, the application typically being performed for a time of between 1 and 20 seconds, especially between 3 and 15 seconds.

The surfactant(s) are preferably chosen from anionic surfactants, amphoteric surfactants and nonionic surfactants, and mixtures thereof.

A subject of the invention is also a washing system, comprising:

- a pipe for circulating a liquid,
- a device for feeding the pipe with water,
- at least one source of product, the product comprising one or more surfactants,
- a device for injecting product into the pipe to form a treatment solution comprising one or more surfactants in a content ranging from 0.35% to 1.5% by weight relative to the total weight of the treatment solution,
- a dispensing device for delivering the treatment solution with a flow rate of between 0.5 and 5 L/min, better still between 0.8 and 3 L/min Anionic Surfactants The term "anionic surfactant" means a surfactant comprising, as ionic or ionizable groups, only anionic groups.

In the present description, a species is termed "anionic" when it bears at least one permanent negative charge or when it can be ionized into a negatively charged species, under the conditions of use of the composition of the invention, for example the medium or the pH, and not comprising any cationic charge.

The anionic surfactants may be sulfate, sulfonate and/or carboxylic (or carboxylate) surfactants. Needless to say, a mixture of these surfactants may be used.

It is understood in the present description that:

- the carboxylate anionic surfactants comprise at least one carboxylic or carboxylate function (—COOH or —$COO^-$) and may optionally also comprise one or more sulfate and/or sulfonate functions;
- the sulfonate anionic surfactants comprise at least one sulfonate function (—$SO_3H$ or —$SO_3^-$) and may optionally also comprise one or more sulfate functions, but do not comprise any carboxylate functions; and
- the sulfate anionic surfactants comprise at least one sulfate function but do not comprise any carboxylate or sulfonate functions.

Carboxylate Anionic Surfactants

The carboxylic anionic surfactants that may be used thus comprise at least one carboxylic or carboxylate function (—COOH or —$COO^-$).

They may be chosen from the following compounds: acylglycinates, acyllactylates, acylsarcosinates, acylglutamates; alkyl-D-galactosideuronic acids, alkyl ether carboxylic acids, alkyl(C6-30 aryl) ether carboxylic acids, alkylamido ether carboxylic acids; and also the salts of these compounds;

the alkyl and/or acyl groups of these compounds comprising from 6 to 30 carbon atoms, especially from 12 to 28, better still from 14 to 24 or even from 16 to 22 carbon atoms; the aryl group preferably denoting a phenyl or benzyl group;

these compounds possibly being polyoxyalkylenated, in particular polyoxyethylenated, and then preferably comprising from 1 to 50 ethylene oxide units and better still from 2 to 10 ethylene oxide units.

Use may also be made of the C6-C24 alkyl monoesters of polyglycoside-polycarboxylic acids, such as C6-C24 alkyl polyglycoside-citrates, C6-C24 alkyl polyglycoside-tartrates and C6-C24 alkyl polyglycoside-sulfosuccinates, and salts thereof.

Among the above carboxylic surfactants, mention may be made most particularly of polyoxyalkylenated alkyl(amido) ether carboxylic acids and salts thereof, in particular those comprising from 2 to 50 alkylene oxide and in particular ethylene oxide groups, such as the compounds sold by the company Kao under the Akypo names.

The polyoxyalkylenated alkyl(amido)ether carboxylic acids that may be used are preferably chosen from those of formula (1):

$$R_1(OC_2H_4)_n—OCH_2COOA \quad (1)$$

in which:

R1 represents a linear or branched C6-C24 alkyl or alkenyl radical, an alkyl(C8-C9)phenyl radical, a radical R2CONH—CH2-CH2- with R2 denoting a linear or branched C9-C21 alkyl or alkenyl radical, preferably, R1 is a C8-C20 and preferably C8-C18 alkyl radical, and aryl preferably denotes phenyl, n is an integer or decimal number (average value) ranging from 2 to 24 and preferably from 2 to 10, A denotes H, ammonium, Na, K, Li, Mg or a monoethanolamine or triethanolamine residue.

It is also possible to use mixtures of compounds of formula (1), in particular mixtures of compounds containing different groups R1.

The polyoxyalkylenated alkyl(amido)ether carboxylic acids that are particularly preferred are those of formula (1) in which:

R1 denotes a C12-C14 alkyl, cocoyl, oleyl, nonylphenyl or octylphenyl radical,

A denotes a hydrogen or sodium atom, and n ranges from 2 to 20, preferably from 2 to 10.

Even more preferentially, use is made of compounds of formula (1) in which R denotes a C12 alkyl radical, A denotes a hydrogen or sodium atom and n ranges from 2 to 10.

Preferentially, the carboxylic anionic surfactants are chosen, alone or as a mixture, from:

acylglutamates, in particular of C6-C24 or even C12-C20, such as stearoylglutamates, and in particular disodium stearoylglutamate;

acylsarcosinates, in particular of C6-C24 or even C12-C20, such as palmitoylsarcosinates, and in particular sodium palmitoylsarcosinate;

acyllactylates, in particular of C12-C28 or even C14-C24, such as behenoyllactylates, and in particular sodium behenoyllactylate;

C6-C24 and especially C12-C20 acylglycinates;

(C6-C24)alkyl ether carboxylates and especially (C12-C20)alkyl ether carboxylates;

polyoxyalkylenated ($C_6$-$C_{24}$)alkyl(amido) ether carboxylic acids, in particular those comprising from 2 to 50 ethylene oxide groups;

in particular in the form of alkali metal or alkaline-earth metal, ammonium or amino alcohol salts.

Sulfonate Anionic Surfactants

The sulfonate anionic surfactants that may be used comprise at least one sulfonate function (—$SO_3H$ or —$SO_3^-$).

They may be chosen from the following compounds: alkylsulfonates, alkylamidesulfonates, alkylarylsulfonates, α-olefinsulfonates, paraffin sulfonates, alkylsulfosuccinates, alkyl ether sulfosuccinates, alkylamidesulfosuccinates, alkylsulfoacetates, N-acyltaurates, acylisethionates; alkylsulfolaurates; and also the salts of these compounds;

the alkyl groups of these compounds comprising from 6 to 30 carbon atoms, in particular from 12 to 28, better still from 14 to 24 or even from 16 to 22 carbon atoms; where the aryl group preferably denotes a phenyl or benzyl group;

these compounds possibly being polyoxyalkylenated, in particular polyoxyethylenated, and then preferably comprising from 1 to 50 ethylene oxide units and better still from 2 to 10 ethylene oxide units.

Preferentially, the sulfonate anionic surfactants are chosen, alone or as a mixture, from:

C6-C24 and especially C12-C20 alkylsulfosuccinates, especially laurylsulfosuccinates;

C6-C24 and especially C12-C20 alkyl ether sulfosuccinates;

(C6-C24)acylisethionates and preferably (C12-C18)acylisethionates;

in particular in the form of alkali metal or alkaline-earth metal, ammonium or amino alcohol salts.

Sulfate Anionic Surfactants

The sulfate anionic surfactants that may be used comprise at least one sulfate function (—$OSO_3H$ or —$OSO_3^-$).

They may be chosen from the following compounds: alkyl sulfates, alkyl ether sulfates, alkylamido ether sulfates, alkylaryl polyether sulfates, monoglyceride sulfates; and the salts of these compounds;

the alkyl groups of these compounds comprising from 6 to 30 carbon atoms, in particular from 12 to 28, better still from 14 to 24 or even from 16 to 22 carbon atoms; where the aryl group preferably denotes a phenyl or benzyl group;

these compounds possibly being polyoxyalkylenated, in particular polyoxyethylenated, and then preferably comprising from 1 to 50 ethylene oxide units and better still from 2 to 10 ethylene oxide units.

Preferentially, the sulfate anionic surfactants are chosen, alone or as a mixture, from:

alkyl sulfates, in particular of C6-C24 or even C12-C20, alkyl ether sulfates, in particular of C6-C24 or even C12-C20, preferably comprising from 2 to 20 ethylene oxide units;

in particular in the form of alkali metal or alkaline-earth metal, ammonium or amino alcohol salts.

Salts

When the anionic surfactant is in salt form, said salt may be chosen from alkali metal salts, such as the sodium or potassium salt, ammonium salts, amine salts and in particular amino alcohol salts, and alkaline-earth metal salts, such as the magnesium salt.

Examples of amino alcohol salts that may be mentioned include monoethanolamine, diethanolamine and triethanolamine salts, monoisopropanolamine, diisopropanolamine or triisopropanolamine salts, 2-amino-2-methyl-1-propanol salts, 2-amino-2-methyl-1,3-propanediol salts and tris(hydroxymethyl)aminomethane salts.

Alkali metal or alkaline-earth metal salts and in particular the sodium or magnesium salts are preferably used.

Preferentially, the anionic surfactants are chosen, alone or as a mixture, from:

C6-C24 and especially C12-C20 alkyl sulfates;

C6-C24 and especially C12-C20 alkyl ether sulfates; preferably comprising from 2 to 20 ethylene oxide units;

C6-C24 and especially C12-C20 alkylsulfosuccinates, especially laurylsulfosuccinates;

C6-C24 and especially C12-C20 alkyl ether sulfosuccinates;

(C6-C24)acylisethionates and preferably (C12-C18)acylisethionates;

C6-C24 and in particular C12-C20 acylsarcosinates; in particular palmitoylsarcosinates;

(C6-C24)alkyl ether carboxylates, preferably (C12-C20) alkyl ether carboxylates;

polyoxyalkylenated ($C_6$-$C_{24}$)alkyl(amido) ether carboxylic acids and salts thereof, in particular those comprising from 2 to 50 alkylene oxide and in particular ethylene oxide groups;

C6-C24 and especially C12-C20 acylglutamates;

C6-C24 and especially C12-C20 acylglycinates;

in particular in the form of alkali metal or alkaline-earth metal, ammonium or amino alcohol salts.

Amphoteric Surfactants

The amphoteric surfactants that may be used in the invention may be optionally quaternized secondary or tertiary aliphatic amine derivatives, in which the aliphatic group is a linear or branched chain comprising from 8 to 22 carbon atoms, said amine derivatives containing at least one anionic group, for instance a carboxylate, sulfonate, sulfate, phosphate or phosphonate group.

Mention may be made in particular of betaines and sulfobetaines (or sultaines), and also mixtures thereof, and in particular, alone or as a mixture:

betaine, (C8-C20)alkyl betaines, and especially cocoyl betaine;

(C8-C20)alkylamido(C1-C6)alkyl betaines, and in particular (C8-C20)alkylamidopropyl betaines such as cocamidopropyl betaine, (C8-C20)alkyl sulfobetaines.

Among the derivatives of optionally quaternized secondary or tertiary aliphatic amines that may be used, mention may also be made of the products having respective structures (A1) and (A2) below:

Ra—CON(Z)CH2-(CH2)m-N+(Rb)(Rc)(CH2COO—) (A1)

in which:

Ra represents a C10-C30 alkyl or alkenyl group derived from an acid Ra-COOH preferably present in hydrolysed coconut oil, a heptyl group, a nonyl group or an undecyl group, Rb represents a β-hydroxyethyl group, Rc represents a carboxymethyl group, m is equal to 0, 1 or 2, Z represents a hydrogen atom or a hydroxyethyl or carboxymethyl group, Ra'-CON(Z)CH2-(CH2)m'-N(B)(B') (A2)

in which:

B represents —CH2CH2OX' with X' representing —CH2-COOH, CH2-COOZ', —CH2CH2-COOH, —CH2CH2-COOZ', or a hydrogen atom, B' represents —(CH2)z-Y', with z=1 or 2, and Y' representing —COOH, COOZ', —CH2-CHOH—SO3H or —CH2-CHOH—SO3Z', m' is equal to 0, 1 or 2, Z represents a hydrogen atom or a hydroxyethyl or carboxymethyl group, Z' represents an ion derived from an alkali metal or alkaline-earth metal, such as sodium, potassium or magnesium; an ammonium ion; or an ion derived from an organic amine and especially from an amino alcohol, such as monoethanolamine, diethanolamine and triethanolamine, monoisopropanolamine, diisopropanolamine or triisopropanolamine, 2-amino-2-methyl-1-propanol, 2-amino-2-methyl-1,3-propanediol and tris(hydroxymethyl)aminomethane.

Ra' represents a C10-C30 alkyl or alkenyl group of an acid Ra'COOH preferably present in hydrolysed coconut oil or hydrolysed linseed oil, an alkyl group, in particular a C17 alkyl group, and its iso form, or an unsaturated C17 group.

The compounds corresponding to formula (A2) are particularly preferred.

Among the compounds of formula (A2) for which X' represents a hydrogen atom, mention may be made of the compounds known under the (CTFA) names sodium cocoamphoacetate, sodium lauroamphoacetate, sodium caproamphoacetate and sodium capryloamphoacetate.

Other compounds of formula (A2) are known under the (CTFA) names disodium cocoamphodiacetate, disodium lauroamphodiacetate, disodium caproamphodiacetate, disodium capryloamphodiacetate, disodium cocoamphodipropionate, disodium lauroamphodipropionate, disodium caproamphodipropionate, disodium capryloamphodipropionate, lauroamphodipropionic acid and cocoamphodipropionic acid.

As examples of compounds of formula (A2), mention may be made of the cocoamphodiacetate sold by the company Rhodia under the trade name Miranol® C2M Concentrate, the sodium cocoamphoacetate sold under the trade name Miranol Ultra C 32 and the product sold by the company Chimex under the trade name Chimexane HA.

Use may also be made of the compounds of formula (A3):

Ra''-NH—CH(Y'')—(CH2)n-C(O)—NH—(CH2)n'-N(Rd)(Re) (A3)

in which:

Ra'' represents a C10-C30 alkyl or alkenyl group of an acid;

Ra''-C(O)OH, which is preferably present in coconut kernel oil or in hydrolysed linseed oil;

Y'' represents the group C(O)OH, —C(O)OZ'', —CH2-CH(OH)—SO3H or the group CH2-CH(OH)—SO3-Z'', with Z'' representing a cation resulting from an alkali metal or alkaline-earth metal, such as sodium, an ammonium ion or an ion resulting from an organic amine;

Rd and Re, independently of each other, represent a C1-C4 alkyl or hydroxyalkyl radical; and n and n', independently of each other, denote an integer ranging from 1 to 3.

Among the compounds of formula (A3), mention may be made especially of the compound classified in the CTFA dictionary under the name sodium diethylaminopropyl cocoaspartamide and especially the compound sold by the company Chimex under the name Chimexane HB.

Preferably, the amphoteric surfactants are chosen from betaine, (C8-C20)alkyl betaines, (C8-C20)alkylamido(C1-C6)alkyl betaines, (C8-C20)alkylamphoacetates and (C8-C20)alkylamphodiacetates, and mixtures thereof, and in particular from cocoyl betaine and cocoamidopropyl betaine.

Nonionic Surfactants

The nonionic surfactants that may be used in the invention may be chosen from alcohols, α-diols and (C1-20)alkylphenols, these compounds being polyethoxylated and/or polypropoxylated and/or polyglycerolated, the number of ethylene oxide and/or propylene oxide groups possibly ranging from 1 to 100, and the number of glycerol groups possibly ranging from 2 to 30; or alternatively these compounds comprising at least one fatty chain comprising from 8 to 30 carbon atoms and especially from 16 to 30 carbon atoms.

Mention may also be made of condensates of ethylene oxide and of propylene oxide with fatty alcohols; polyethoxylated fatty amides preferably containing from 2 to 30 ethylene oxide units, polyglycerolated fatty amides comprising on average from 1 to 5, and in particular from 1.5 to 4, glycerol groups; ethoxylated fatty acid esters of sorbitan preferably containing from 2 to 40 ethylene oxide units, fatty acid esters of sucrose, polyoxyalkylenated and preferably polyoxyethylenated fatty acid esters containing from 2 to 150 mol of ethylene oxide, including oxyethylenated plant oils, N—(C6-24 alkyl)glucamine derivatives, amine oxides such as (C10-14 alkyl)amine oxides or N—(C10-14 acyl) aminopropylmorpholine oxides.

Mention may also be made of nonionic surfactants of alkyl(poly)glycoside type, represented especially by the following general formula: R1O—(R2O)t-(G)v in which:

- R1 represents a linear or branched alkyl or alkenyl radical comprising 6 to 24 carbon atoms and especially 8 to 18 carbon atoms, or an alkylphenyl radical whose linear or branched alkyl radical comprises 6 to 24 carbon atoms and especially 8 to 18 carbon atoms,
- R2 represents an alkylene radical comprising 2 to 4 carbon atoms,
- G represents a sugar unit comprising 5 to 6 carbon atoms,
- t denotes a value ranging from 0 to 10 and preferably 0 to 4,
- v denotes a value ranging from 1 to 15 and preferably 1 to 4.

Preferably, the alkyl(poly)glycoside surfactants are compounds of the formula described above in which:

- R1 denotes a linear or branched, saturated or unsaturated alkyl radical comprising from 8 to 18 carbon atoms,
- R2 represents an alkylene radical comprising 2 to 4 carbon atoms,
- t denotes a value ranging from 0 to 3 and preferably equal to 0,
- G denotes glucose, fructose or galactose, preferably glucose;
- the degree of polymerization, i.e. the value of v, possibly ranging from 1 to 15 and preferably from 1 to 4; the mean degree of polymerization more particularly being between 1 and 2.

The glucoside bonds between the sugar units are generally of 1-6 or 1-4 type and preferably of 1-4 type. Preferably, the alkyl(poly)glycoside surfactant is an alkyl(poly)glucoside surfactant. C8/C16 alkyl(poly)glucosides 1,4, and in particular decyl glucosides and caprylyl/capryl glucosides, are most particularly preferred.

Among the commercial products, mention may be made of the products sold by the company Cognis under the names Plantaren® (600 CS/U, 1200 and 2000) or Plantacare® (818, 1200 and 2000); the products sold by the company SEPPIC under the names Oramix CG 110 and Oramix® NS 10; the products sold by the company BASF under the name Lutensol GD 70, or else the products sold by the company Chem Y under the name AG10 LK.

Preferably, use is made of C8/C16-alkyl (poly)glycosides 1,4, in particular as an aqueous 53% solution, such as those sold by Cognis under the reference Plantacare® 818 UP.

Preferentially, the nonionic surfactants are chosen from (C6-24 alkyl)(poly)glycosides, and more particularly (C8-18 alkyl)(poly)glycosides, ethoxylated C8-C30 fatty acid esters of sorbitan, polyethoxylated C8-C30 fatty alcohols and polyoxyethylenated C8-C30 fatty acid esters, these compounds preferably containing from 2 to 150 mol of ethylene oxide, and mixtures thereof.

Preferably, the surfactant(s) are chosen from anionic surfactants. Preferably, the treatment solution comprises one or more anionic surfactants in a content ranging from 0.25% to 1% by weight of surfactant(s) relative to the total weight of the treatment solution, better still from 0.4% to 1% by weight relative to the total weight of the treatment solution, preferably strictly less than 1% relative to the total weight of the treatment solution. Preferably, the product injection device injects between 2.5 g/minute and 20 g/minute of one or more anionic surfactants into the pipe.

Preferably, the water hardness is less than or equal to 45° f.

The product may be a surfactant that is substantially pure or diluted in a solvent, for example in water, and optionally comprising one or more additional compounds such as thickeners, fragrances and/or treatment compounds.

Preferably, the system comprises a pressure booster to increase the pressure of the water at the inlet of the dispensing device beyond the pressure of the water at the inlet of the system.

The dispensing device can deliver the treatment solution at a pressure of between 5 and 40 bar, better still between 10 and 25 bar. Such a pressure facilitates the penetration of the drops of the treatment solution into the head of hair, which improves the hair treatment.

The dispensing device may comprise at least two nozzles arranged so as to cause two jets leaving the dispensing device to collide. The two nozzles generate jets, which are preferably convergent, which come into collision so as to reduce their speed and to transfer this kinetic energy into reduction of the size of the drops; this makes it possible to have a wetting resultant jet while at the same time having low water consumption and not producing an unpleasant sensation on the scalp.

It is also particularly advantageous to have low water consumption for salons which are not connected to mains water supplies, or which are connected to sporadic mains water supplies.

The pipe may be defined by a tube or by any member equipped with an internal channel in which water can circulate. This term should therefore not be understood in a limiting manner.

The injection device may comprise a valve which may be in an open or closed position so as optionally to inject the product into the pipe. It is then possible, once the product has been applied, to place the valve in the closed position so as to deliver onto the hair surfactant-free rinsing water, in order to rinse the hair at a flow rate of between 0.5 and 5 L/minute. Rinsing takes less than 1 minute, better still less than 40 seconds.

The system is advantageously arranged so as to control not only the amount of each product that is delivered onto the head of hair, but also the amount of water that is dispensed; knowledge of the amount of water dispensed may be useful especially when the water and the product(s) are dispensed on the head of hair while the sink outlet is closed, since this makes it possible to more readily determine the concentration of each product in the solution present in the sink.

The system may comprise a member for controlling the amount of water dispensed and/or, preferably, a member for controlling the amount of product injected into the water and also, where appropriate, a member for controlling the flow rate of liquid delivered by the dispensing device.

The head of hair is preferably treated in a sink, the system being configured to control the outlet of this sink, especially so as to open it or to close it as a function of the treatment or rinsing requirement.

The system may be configured to automatically control the opening or closing of the sink outlet as a function of the nature of the treatment; for example, during rinsing, the system orders the opening of the outlet; on the other hand, during the dispensing of a predefined treatment product, the system orders the closing of this outlet.

The system may comprise a user interface enabling said user:

- to select a setting, the system being configured to act on an adjustment device for varying the product content as a function of the selected setting, and/or
- to input at least one item of information relating to a treatment result obtained with the selected setting.

The term "treatment result" should be understood as meaning a result associated at least partly with the use of a treatment solution. This may be the degree of cleansing, the foaming power, the speed of foaming, or a disentangling, smoothing, conditioning or care strength, etc.

The user interface is preferably produced so as to enable the user to modify various treatment parameters, such as the amount of product(s) injected or the flow rate of liquid, and/or various rinsing parameters, so as to perform several tests, and thus to determine the best treatment and/or rinsing conditions.

This gives the person performing the shampoo wash the possibility of determining the best treatment conditions for his client and enables the user to perform setting tests and, once happy with the result, to record the conditions for the use of these products, especially the amounts and/or concentrations.

The system may be configured to allow memorization of a setting used by means of the user interface. The system especially comprises a means for memorizing at least one setting by associating it with a person and/or a person's identification code. The setting may be stored in memory automatically or at the user's request when a treatment result is input into the system.

The means for memorizing at least one setting may be an electronic or computer memory, for example a memory of SSD disk or hard disk or collective type, commonly known as a "cloud". The information may be stored in memory in the system itself, in a circuit board located close to the washing sink, or on a remote server, present in the salon or outside same. When the system is used to automatically or semi-automatically generate a setting based on data stored in memory, it is advantageous to give the system access to the salon's booking system so as to know the identity of the person treated from this booking system, which avoids having to input it into the system; in semiautomatic operation, the system may be arranged to display, on the user interface, the identity of the person as determined by accessing the booking system, in order to enable the person performing the shampoo wash to confirm this information before starting the treatment; it may also be preferable for the system to recall the treatment that it is preparing to perform automatically, so as to enable the person performing the shampoo wash to input a confirmation.

The system may be arranged to automatically perform pre-adjustment of the concentration of product as a function of at least one item of information input into the system by the user. For example, the system is configured to adjust the amount of product(s) injected into the water as a function of a flow rate selected by the user in order to obtain a desired concentration.

The recorded information may then be able to be used to reproduce the treatment when the person concerned returns to the salon.

This information may also make it possible to fine-tune the treatment to come close to an optimal result, by noting, bit by bit, the change in the results as a function of the treatments. Thus, the system may be arranged to propose a new setting as a function on the one hand of recorded data relating to results previously observed and the corresponding treatment conditions, and on the other hand a request expressed by the client and/or the user and input into the system.

The system may be arranged to enable the user to input information thereon relating to the head of hair to be treated, for example length, consistency, colour, dyeing, relaxing or permanent-wave history, styling habits, regular use of heating systems, state of the hair, etc., and to take these indications into account in the setting proposals made. The system may further use the information input to modify settings stored in memory for a given client, in order to take account of changes in their head of hair since the previous visit to the salon; for example, the system is arranged to modify the amounts of water and/or product(s) conveyed to the hair as a function of the change in the length thereof since the previous visit to the salon. For example, if the hair is shorter due to a haircut performed after the last washing operation, the system may reduce the amounts of water and of products used. The system may be arranged to enable the person performing the shampoo wash to input an item of information regarding the length of the head of hair, for example the length in cm thereof. As a variant, the system is arranged to measure it automatically, by virtue, for example, of one or more sensors fitted in the sink.

The system may be arranged to enable the input of data relating to a result obtained after drying and/or styling the head of hair, and to automatically propose an optional modification of the setting at the next treatment of the head of hair as a function of these data.

The system may, automatically or non-automatically, have information input relating to rinsing parameters, in order to be able to reuse them subsequently. In particular, the system may be arranged to determine the amount of rinsing solution used, and to store this parameter in memory. The person performing the shampoo wash may then find the optimal rinsing depending on whether he or she wishes for the hair to be perfectly free of product or to still carry some traces of product and thereby obtain an effect such as care, sheen, etc.

In particular, during rinsing, he or she may thus input information into the system relating to the quality of the hair and the speed of rinsing. The system may then take account thereof in order to modify the settings, for example the flow rate of rinsing liquid, or suggest testing new settings, for example performing the rinsing at a different flow rate.

The system may be arranged to allow tests to be performed on the head of hair with a flow rate of rinsing liquid different from that which is subsequently used.

The system according to the invention enables the person performing the shampoo wash to optimize the nature of the products, the amounts applied and also the amount of rinsing water. It makes it possible to record the tests and the optimum settings. The user can thus improve the performance beyond that which would have been possible by their skills of assessment.

The invention may enable the user to reuse settings, to improve them and to adapt them to changes in the head of hair. This also enables savings of time and of product. Moreover, since the user does not have to reproduce the settings during the client's subsequent visits, he or she subsequently takes only a very short amount of time to satisfy the client.

The invention also makes it possible to reduce water losses, when the system is created such that the information relating to optimal rinsing is retained and reused.

In one exemplary embodiment of the invention, the user shares this information, in particular via digital connections, to inform other salons.

Thus, another subject of the invention is a set of systems according to the invention, present in different salons, configured to share information with one another, especially relating to settings and/or sequences considered to be optimal for given types of heads of hair. The systems may especially communicate via a shared database which they may remotely interrogate and input information into.

The system may be arranged such that a given hairdresser may search a database, by means of the client's identification, for example by their name, by an email address, by a pseudonym, by a client number, etc., of a description of the head of hair, for example volume, length, ethnicity, etc., or of a description of a history, for example number of dyeing operations, use of dyes of brand Y, etc., in order to receive from the system, by comparison, a setting and/or treatment sequence proposal.

The invention may also serve for a salon or a person performing the shampoo wash to build up a professional identity, recognizable by the mixtures and successions that they provide.

The system according to the invention may also have at least one of the characteristics listed below, or any combination thereof:

Process

A subject of the invention is also a hair treatment process comprising the treatment step consisting in spraying the head of hair with a treatment solution comprising water and one or more surfactants at a flow rate of between 0.5 and 5 L/minute, better still between 0.8 and 3 L/minute, the treatment solution comprising one or more surfactants in a content ranging from 0.35% to 1.5% by weight of surfactant(s) relative to the total weight of the treatment solution, preferably from 0.6% to 1.2% by weight relative to the total weight of the treatment solution.

Preferably, the surfactant(s) are chosen from anionic surfactants. Preferably, the treatment solution comprises one or more anionic surfactants in a content ranging from 0.25% to 1% by weight relative to the total weight of the treatment solution, better still from 0.4% to 1% by weight relative to the total weight of the treatment solution, preferably strictly less than 1% by weight relative to the total weight of the treatment solution. Preferably, the flow rate of anionic surfactants is between 2.5 g/minute and 20 g/minute.

The process may be performed using the system described previously.

The treatment solution may comprise one or more additional compounds, especially thickeners, fragrances or treatment compounds, such as silicone.

The additional compound(s) and the surfactant(s) may be contained in a single product mixed with water to form the treatment solution.

As a variant, the additional compound(s) and the surfactant(s) are in several products mixed together or sequentially with water to form the treatment solution.

Preferably, the treatment step lasts between 1 and 30 seconds and better still between 3 and 15 seconds.

The process preferably comprises a step of rinsing the head of hair with a rinsing solution after the treatment step.

The rinsing step preferably takes less than 1 minute, better still less than 40 seconds. The rinsing step preferably takes place without any lather being produced.

The rinsing step is preferentially performed at a rinsing solution flow rate of between 0.5 and 5 L/minute.

Preferably, the rinsing solution is water, optionally containing other compounds with the exception of surfactants.

The process may comprise a step of adjusting the appropriate amount of surfactant(s) for a given treatment.

The process may comprise a step of memorizing a setting, especially the surfactant concentration, the application flow rate, the application time and/or the rinsing time. The setting stored in memory may be assigned to a person and/or to a person's identification code. The memorization may take place on a remote server and/or on a removable memory medium. This makes it possible to perform a subsequent treatment with the same settings.

The process may comprise a step of selecting a prerecorded setting, preferably in a database, in particular a setting assigned to a person and/or to a person's identification code.

The process may comprise a step of controlling the amount of surfactants delivered onto the hair and/or a step of controlling the amount of water delivered onto the hair and/or a step of controlling the flow rate of the treatment step and/or of the rinsing step.

Preferably, the process comprises one or more steps of controlling the opening or closing of the outlet of the treatment sink as a function of the nature of the operation taking place, especially the treatment or rinsing operation.

BRIEF DESCRIPTION OF THE FIGURES

Other characteristics and advantages of the present invention will become apparent on reading the following detailed description of nonlimiting exemplary embodiments thereof and on examining the appended drawing, in which.

DETAILED DESCRIPTION

System

Figure 1:
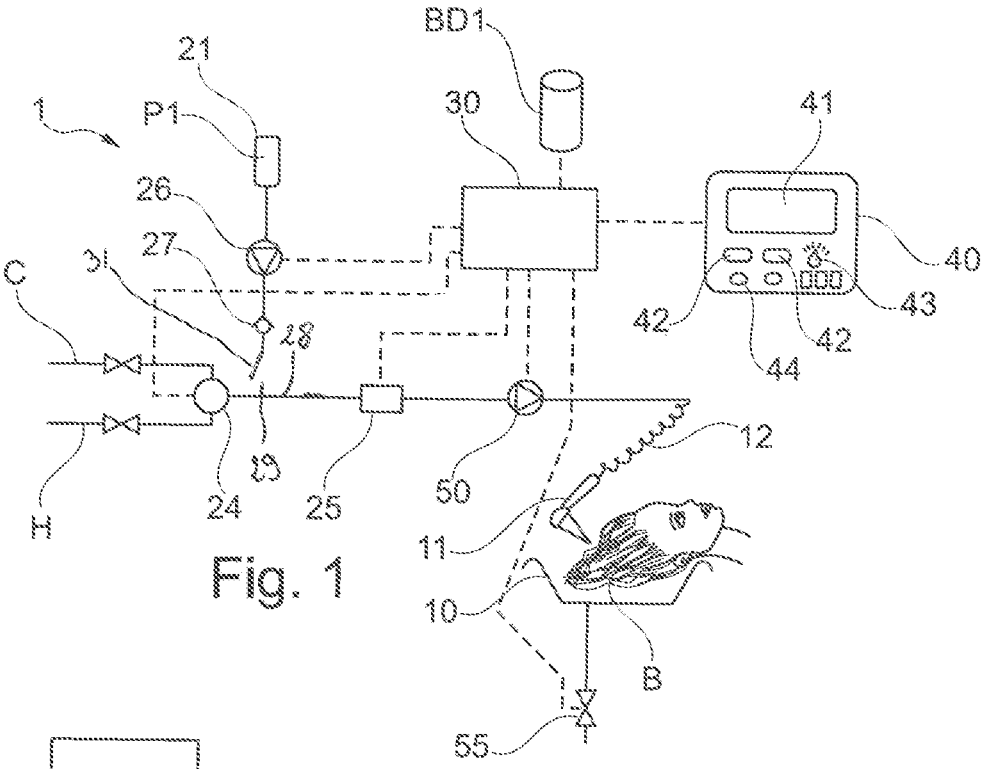
FIG. 1 is a partial schematic representation of an example of a treatment system according to the invention.
Figure 2:
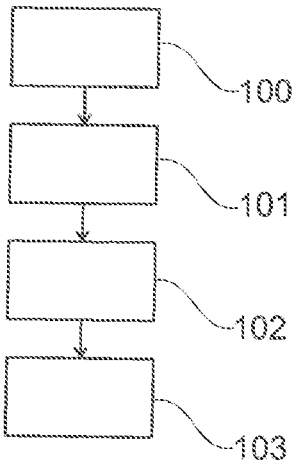
FIG. 2 illustrates various steps of an example of a process according to the invention.

FIG. 1 represents a system 1 according to the invention, to be connected to a cold water inlet C and preferably also, as illustrated, to a hot water inlet H.

This system 1 is intended to be used in a hairdressing salon to treat the head of hair B of a client whose head is positioned over a washing sink 10 which serves to collect the water and the product(s) used to treat the head of hair. This sink is, as is known per se, connected to an outlet system for waste water. The system 1 comprises a certain number of connectors and pipes for conveying the water to a dispensing device 11 such as a small shower connected to a flexible hose 12.

In accordance with the invention, the system 1 comprises one or more sources of products for treating the head of hair, for example a product P1 in the example in question, contained in a tank 21.

A collection device makes it possible to collect, in a dosed manner, the product P1 with a view to dispensing it via the dispensing device 11. The product P1 is dosed under the control of an adjustment device 30 comprising, in the example in question, an electronic unit provided with computer means enabling it to communicate with a user interface 40, schematically represented in FIG. 1, and also with one or more databases DB1 containing client data, especially treatment setting data associated with a client and/or a client's identification code.

In the illustrated example, the system 1 comprises temperature control means, such as a mixer 24, controlled by the adjustment device 30, to mix hot water with cold water in a pipe 28 in order to dispense water with the dispensing device 11 at the desired temperature.

The system 1 may also comprise a flowmeter 25, giving information to the adjustment device 30 relating to the flow rate of the liquid delivered to the dispensing device 11, and, by integration, relating to the amount of liquid dispensed.

The system 1 may also, where appropriate, comprise one or more other sensors, not shown, giving information to the adjustment device 30 relating to the amount and/or the flow rate of the product and/or water delivered to the dispensing device 11.

In the illustrated example, the product P1 is collected by means of metering pumps 26, for example of peristaltic type or having a motorized piston, controlled by the adjustment device 30. Nonreturn valves 27 may be present downstream of the pumps 26, these valves 27 opening under the dispensing pressure of the pumps 26.

The liquid is delivered onto the hair at a low flow rate, the pressure provided to the dispensing device 11 being increased by means of a pressure booster 50. The pressure of the liquid exiting the device is between 0.8 and 3 L/minute.

The dispensing device 11 comprises nozzles which direct convergent jets towards each other, so as to make them break each other to reinforce the wetting effect on the hair without giving an unpleasant sensation.

The product P1 used by the system 1 is, for example, a product for treating the head of hair used when it is shampooed, and more generally during a client's session at the sink in the salon.

The product P1 comprises one or more surfactants, chosen especially from anionic surfactants, which are optionally sulfate-based, and especially carboxylic, amphoteric surfactants, such as the betaine surfactant, and/or nonionic surfactants. The product P1 may also comprise additional compounds such as thickeners, fatty substances such as oils and/or waxes, and water.

The product P1 is preferably contained in a container which is easily connected to the system 1. For example, the system 1 comprises quick connectors, which enables easy replacement of an empty container.

The product P1 may be contained in flexible pouches which deform as they are emptied, so as to enable the container to be emptied without taking up air, for better preservation of said container.

The initial amount of the treatment product in the corresponding container is, for example, between 10 ml and 1 litre.

In the example under consideration, the product P1 is injected into the pipe 28 containing water via an injection device 29 to form a treatment solution which is then conveyed to the dispensing device 11. The adjustment device 30 can control the duration of operation of the pump 26 and also the flow rate thereof to control the amount of product P1 delivered onto the head of hair B and the flow rate at which the product P1 is injected.

The amount of product P1 injected into the water is such that the surfactant content in the treatment solution is between 0.35% and 1.5% by weight relative to the total weight of the treatment solution, and preferentially between 0.6% and 1.2% by weight relative to the total weight of the treatment solution. Preferably, the surfactant(s) are chosen from anionic surfactants. Preferably, the treatment solution comprises one or more anionic surfactants in a content ranging from 0.25% to 1% by weight relative to the total weight of the treatment solution, better still from 0.4% to 1%, preferably strictly less than 1% relative to the total mass of the treatment solution. Preferably, the product injection device injects between 2.5 g/minute and 20 g/minute of anionic surfactants into the pipe.

The system 1 may make it possible, by means of the user interface 40, to vary the amount of product P1 delivered onto the head of hair, and also, where appropriate, the concentration of this product in the water which is dispensed by the dispensing device 11. It is thus possible to not deliver any product P1 into the water, in particular during the rinsing step.

In particular, the system may comprise a valve 31 which can be placed in an open position in which the product P1 is injected into the water and a closed position in which the product P1 cannot be injected into the water. The valve 31 especially moves to the closed position during the step of rinsing the hair.

As a variant, it is possible to have several products contained in several containers. The products may differ in their composition or in their concentration of one or more compounds. The adjustment device 30 makes it possible to control the amount of each of the products that is conveyed in the water.

In another implementation variant, the system 1 is arranged to perform premixing of the product with water so as to modify the concentration thereof by diluting it, and the result of this mixing is then conveyed to the dispensing device 11 via a specific tube. This makes it possible to avoid diluting the product in too great an amount of water and/or improves the dilution of the product in the water, for instance in the case of oil-based products.

As a further variant, the system 1 is arranged to perform premixing of several products with each other in predetermined ratios to produce a mixture to be injected into the water to produce a treatment solution.

The system 1 may be arranged to indicate to the person performing the shampoo wash, via the user interface 40, the amount of a product already dispensed onto the head of hair and/or the amount of product remaining in the corresponding container.

The system 1 may also be arranged to indicate, preferably in real time, the amount of a product remaining to be dispensed and/or to be dispensed during the treatment.

The system may be arranged to indicate the amount of water dispensed, and/or the water flow rate, and also the temperature thereof, where appropriate.

All these items of information are, for example, displayed on a screen 41 of the user interface 40.

The user interface 40 may be embodied in various ways. Preferably, the user interface 40 is located close to the sink 10, so as to enable the person performing the shampoo wash to modify the treatment parameters and especially to select the amount and/or the content of product in the water delivered onto the head of hair. The adjustments are made, for example, by means of keys 42 for increasing or decreasing selection parameters for amounts or concentrations.

Where appropriate, the user interface 40 also has a button for setting the temperature of the water, the mixer 24 being, for example, motorized. As a variant, the system 1 comprises a temperature probe and solenoid valves for adjusting the flow rate of hot water and of cold water so as to comply with a nominal temperature.

The user interface 40 may also comprise one or more buttons 44 for selecting actions and/or parameters in the menu displayed on the screen 41. In variants, the screen 41 is a touchscreen.

The user interface 40 may further comprise voice recognition and/or be constituted by a terminal of tablet or smartphone type, communicating with the adjustment device 30.

The user interface 40 may receive information transmitted remotely from, for example, a computer of the salon, a tablet or a cell phone.

In one variant, at least part of the user interface 40 is present on the dispensing device 11.

Preferably, the user interface 40 is protected from water splashes and makes it possible to make adjustments and/or to input information with wet fingers.

The user interface 40 is configured in the described example to enable the person performing the shampoo wash to input one or more items of information relating to the treatment performed. For example, the person performing the shampoo wash may grade different parameters linked to the use of a product on a predetermined scale of values; for example, the user interface 40 is configured to enable the person performing the shampoo wash to input information relating to the speed of foaming, the volume of foam, the speed of rinsing, the ease of disentangling and/or the cleansing efficiency. This information is, for example, a score, for example a number or a letter, or a symbol, for example of emoticon type.

The user interface 40 may be configured to enable the user to select a pre-recorded and pre-characterized formula, especially from the database DB1. In this case, the system 1 performs the adjustment which corresponds to the selected formulation.

The adjustment device 30 may comprise a circuit containing a microprocessor or containing a microcontroller and a power interface making it possible to control solenoid valves and/or pumps and/or other motors so as to produce the dosages corresponding to the selected treatment configurations.

The adjustment device 30 may receive, by means, for example, of an analogue and digital interface, signals originating from various sensors, for example of temperature, of pressure and/or of flow rate, and also, where appropriate, signals giving information relating to the filling level of the containers containing the products to be used to treat the head of hair.

The adjustment device 30 assembly may be located close to the washing sink 10, for example in a casing which is sealed against water splashes; as a variant, the adjustment device 30 comprises at least one electronic circuit close to the sink 10 and at least one electronic circuit at a distance, communicating via a wired or wireless connection with the electronic circuit(s) present close to the sink 10.

The system 1 may comprise one or more sensors for measuring at least one characteristic of the head of hair before cleansing it, for example a comb to be passed through the hair, provided with a microphone or any other sensor which can sense the state of the hair, making it possible to convey a signal representing the state of the hair before treating it. In this case, the adjustment device 30 may be arranged to recommend a setting as a function of the evaluation which has been made, aided by reference data for this purpose. The sensor(s) may further be used to evaluate a result of treating the head of hair by means of the system 1.

In one variant, the system 1 is arranged to display, on the screen 41 of the user interface 40, a questionnaire which the person performing the shampoo wash fills out and, as a function of the results of this questionnaire, to make a suggestion of a setting or of a modification of said setting.

Preferably, the user interface 40 and/or the adjustment device 30 may download data relating to the client whose hair is going to be treated, from the database DB1, so as to remind the person performing the shampoo wash of past treatment setting(s), observed result(s) and also the recommended setting(s) for the treatment to be performed.

The system 1 preferably comprises a means for storing at least one setting in memory.

The setting may be stored in memory at the request of the person performing the shampoo wash, for example by pressing a button for this purpose on the user interface 40. As a variant, the setting is automatically stored in memory as soon as a treatment result is input. The setting may be stored in memory on a removable memory medium introduced into the adjustment device 30, and/or in a remote database with which the system 1 is in communication, especially the database DB1.

The system 1 may be configured to control the outlet of the sink 10, by acting, for example, on a solenoid valve 55, in order especially to open it or close it as a function of the treatment or rinsing requirement. For example, when the dispensing device 11 dispenses a product, the outlet is closed so as to enable the user to treat the hair with the amount of water and of product dispensed, the product being in a known amount like the water; once the hair has been treated, the outlet is opened to proceed to the rinsing, for example.

Process

An example of a hair treatment process for obtaining efficient washing of the hair in a reduced time while at the same time having low water consumption will now be described.

Firstly, in step 100, the person performing the shampoo wash adjusts the amount of product and/or the concentration of product and/or flow rate of liquid by means of the user interface 40 of the system 1, and can also indicate the choice of product that he or she wishes to use in the case of several products and/or respective concentrations thereof.

Adjustment information may be input as mentioned above, following an assessment questionnaire and/or a measurement taken on the head of hair of the client whose hair is going to be treated.

It is further possible for the step of selecting the settings to be automatic and to result from downloading data specific to the client whose hair is going to be treated, which data are located, for example, on a memory medium, such as a USB stick, provided by this client. The data may further be present in a file recorded on their cell phone or downloaded from an internal database of the hairdressing salon or external thereto, especially the database DB1.

Downloading data relating to previous treatments undergone by the client may enable the person performing the shampoo wash or the system 1 to propose a setting suggestion when the treatment results observed during previous treatments are not entirely satisfactory.

On the other hand, if the correct settings have been found from previous treatments, for example in terms of products used, amount delivered onto the head of hair and also, where appropriate, the chronology of use of different products, then the system 1 may simply signal to the person performing the shampoo wash that the setting parameters that the system 1 proposes to use are those which have been considered to be satisfactory during previous treatments, such that the person performing the shampoo wash only has to confirm the proposal made by the system. In order to find the correct settings and/or the correct treatment sequence, the user may have performed successive tests with the assistance of the system 1 by means of pre-existing test programs as described above.

A concentration and/or an amount may be adjusted in various ways and, for example, the person performing the shampoo wash may simply indicate a desired level of strength of the product.

For example, the person performing the shampoo wash may select, from the user interface 40, from among several degrees such as "less concentrated", "normal concentration", "more concentrated" and the system 1 produces the corresponding dosage.

The flow rate of liquid exiting is between 0.5 and 5 L/minute, better still between 0.8 and 3 L/minute.

The amount of product selected is such that the surfactant content in the treatment solution ranges from 0.35% to 1.5% by weight relative to the total weight of the treatment solution, and preferentially from 0.6% to 1.2% by weight relative to the total weight of the treatment solution.

Preferably, the surfactant(s) are chosen from anionic surfactants. Preferably, the treatment solution comprises one or more anionic surfactants in a content ranging from 0.25% to 1% relative to the total weight of the treatment solution, better still from 0.4% to 1% by weight relative to the total weight of the treatment solution, preferably strictly less than 1% by weight relative to the total weight of the treatment solution. Preferably, the product injection device injects between 2.5 g/minute and 20 g/minute of anionic surfactants into the pipe.

Next, in step 101, the system 1 delivers the treatment solution containing the selected product(s) onto the head of hair in the concentrations and/or with the amounts selected and/or with the selected flow rate.

Step 101 may take between 1 and 20 seconds.

In step 102, the liquid applied to the hair is rinsed out by switching off the injection of product containing surfactants in water. The flow rate of liquid may remain unchanged or may be changed relative to the preceding application.

Step 102 takes less than 1 minute, better still less than 40 seconds.

The system 1 is configured, in the example in question, to record or propose storing in memory, in step 103, a certain number of items of data generated when the client is treated.

These data may be combined with a client ID, so as to be able to be recovered subsequently, for example when the client's head of hair is treated again.

Example A

In this example, one of the tanks of the system 1 is filled with the following product P1:

Product P1: Shampoo whose composition comprises the ingredients indicated in the table below. The amounts are indicated as weight percentages of starting material in unmodified form relative to the total weight of the composition:

| Ingredients | Proportion |
|---|---|
| Disodium cocoamphodiacetate as an aqueous 31.5% solution (Miranol C2M sold by the company Rhodia/Solvay) | 15.87% (5% active material) |
| Sodium lauryl ether sulfate as an aqueous 70% solution (Texapon N70 sold by the company BASF) | 14.28% (10% active material) |
| Water | qs 100 |

At the time of washing the hair, the person washing the hair sets the system according to the invention to deliver:

Test 1: 4% of product P1 in water with a flow rate of 1 L/minute. The mass proportion of surfactant in the water is thus 0.6% and that of anionic surfactant is 0.4%. The flow rate of surfactant in the pipe is 6 g/minute and that of anionic surfactants is 4 g/minute.

Test 2: 2.5% of product P1 in water with a flow rate of 1 L/minute. The mass proportion of surfactant in the water is thus 0.375% and that of anionic surfactant is 0.25%. The flow rate of surfactant in the pipe is 3.75 g/minute and that of anionic surfactant is 2.5 g/minute.

Test 3: 1% of product P1 in water with a flow rate of 1 L/minute. The mass proportion of surfactant in the water is thus 0.15% and that of anionic surfactant is 0.1%. The flow rate of surfactant in the pipe is 1.5 g/minute and that of anionic surfactant is 1 g/minute.

Test 4: 8% of product P1 in water with a flow rate of 1 L/minute. The mass proportion of surfactant in the water is thus 1.2% and that of anionic surfactant is 0.8%. The flow rate of surfactant in the pipe is 12 g/minute and that of anionic surfactant is 8 g/minute.

Tests 1 and 2 are according to the invention and tests 3 and 4 are outside the invention.

These tests are delivered onto a head of natural dry hair about 30 cm long for 12 seconds.

With tests 1, 2 and 4, an abundant foam is obtained. With test 3, an abundant foam is obtained, but it is resorbed when the scalp is massaged.

The hair is then rinsed with clear water at a water flow rate of 1 L/minute. The person performing the shampoo wash stops the rinsing when the head of hair is thoroughly rinsed.

With tests 1 and 2, the rinsing takes 35 and 25 seconds, respectively. With test 3, the rinsing takes 1 minute. With test 4, the rinsing takes 1 minute 30 seconds.

It is thus concluded that, with a low flow rate of liquid, tests 1 and 2, which are according to the invention, allow good application of product and rapid rinsing. Test 3, which has a surfactant proportion below that of the invention, does not allow good application of the product since the disappearance of the foam on massaging prevents identification of the place where the product was applied, which makes it difficult to apply the product uniformly to the head of hair and does not allow rapid rinsing of the head of hair. Test 4, which has a mass proportion of surfactants above that of the invention does not allow rapid rinsing of the head of hair.

Example B

Tests 5 and 6 are performed by applying, by hand, the same amount of product P1 as in tests 1 and 2, respectively. The hair is then rubbed.

The hair is then rinsed with clear water at a water flow rate of 1 L/minute. The person performing the shampoo wash stops the rinsing when the head of hair is thoroughly rinsed.

With test 5, the rinsing takes 3 minutes 5 seconds. With test 6, the rinsing takes 2 minutes 45 seconds.

The rinsing operations of tests 5 and 6 take much longer than those of tests 1 and 2.

Example C

A test 7 is performed by applying, by hand, the same amount of product P1 as in test 2, followed by rinsing with a flow rate of clear water of 12 L/minute. The person performing the shampoo wash stops the rinsing when the head of hair is thoroughly rinsed.

With test 7, the rinsing takes 21 seconds.

Test 2 is thus performed almost as rapidly as when a standard application is performed according to test 7, but with a substantial saving in water, test 2 requiring 0.4 L of water for the rinsing, whereas test 7 requires 4 L of clear water for the rinsing.

Example D

A test 8 is performed by applying a product according to test 2, but by rinsing with clear water at a water flow rate of 12 L/minute.

With test 8, the rinsing takes 14 seconds.

Test 8 thus allows an appreciable saving in water relative to test 7, test 8 requiring 2.8 L of water for the rinsing, whereas test 7 requires 4 L of clear water for the rinsing.

Examples A, B, C and D Performed on Clean Hair

| Test (clean hair) | Application of the surfactant | Rinsing | Rinsing time (s) | Amount of water used for the rinsing (L) | Cleanliness (evaluated after drying) |
|---|---|---|---|---|---|
| 2 | In the low flow-rate stream (1 L/minute) | Low flow-rate stream (1 L/minute) | 25 | 0.4 | Yes |
| 6 | By hand | Low flow-rate stream (1 L/minute) | 165 | 2.75 | Yes |
| 7 | By hand | Standard stream (12 L/minute) | 21 | 4 | Yes |
| 8 | In the low flow-rate stream (1 L/minute) | Standard stream (12 L/minute) | 14 | 2.8 | Yes |

Example E

Test 2 is performed again on hair that has been soiled beforehand with 0.8 g of oleic acid applied to the head of hair. Tests 9 and 10 are also performed, on hair that has also been soiled beforehand with 0.8 g of oleic acid applied to the head of hair, by applying the same amount of product as in test 2 with a flow rate of 12 L/minute. In test 9, the rinsing is performed with a flow rate of 1 L/minute, and in test 10, the rinsing is performed with a flow rate of 12 L/minute. The person performing the shampoo wash stops the rinsing when the head of hair is thoroughly rinsed.

With test 9, the rinsing takes 18 seconds, and with test 10, the rinsing takes 12 seconds. However, the hair appears greasy, which indicates insufficient rinsing. Such is not the case with test 2.

| Test (soiled hair) | Application of the surfactant | Rinsing | Rinsing time (s) | Amount of water used for the rinsing (L) | Cleanliness (evaluated after drying) |
|---|---|---|---|---|---|
| 2 | In the low flow-rate stream (1 L/minute) | Low flow-rate stream (1 L/minute) | 25 | 0.4 | Yes |
| 9 | In a standard stream of water (12 L/minute) | Low flow-rate stream (1 L/minute) | 18 | 0.3 | No |
| 10 | In a standard stream of water (12 L/minute) | Standard stream (12 L/minute) | 12 | 0.2 | No |

Example F

Tests 1 and 2 are performed changing the formulation used. The following formulations are used:

Product P2: Formulation containing a mass proportion of about 15% of an amphoteric surfactant in water, product P2 being a mixture of:

Cocamidopropyl betaine (BASF) composed of 38% by mass of cocoyl amidopropyl betaine in aqueous solution: 39.5% by mass, i.e. about 15% by mass of active material, and Water: qs 100%

Product P3: Formulation containing about 15% of a nonionic surfactant in water, product P3 being a mixture of:

Plantacare 118 UP (BASF) composed of 53% by mass of (C8/C16)alkyl polyglucoside (1.4) in aqueous solution: 29% by mass, i.e. about 15% by mass of active material, and Water: qs 100%

Product P4: Formulation containing non-sulfate sulfur-based surfactants, product P4 being a mixture composed of:

Stepan Mild LSB composed of a mixture of sodium lauryl sulfoacetate and disodium lauryl ether sulfosuccinate in a 50/50 mass ratio in water at 25% by mass:40.5% by mass Sodium cocoyl isethionate: 9% by mass Water: qs 100%

The results are given in the table below.

| Product | Foam | Rinsing time (s) | Amount of water used for the rinsing (L) |
|---|---|---|---|
| P1 | Abundant | 25 | 0.4 |
| P2 | Abundant | 34 | 0.55 |
| P3 | Abundant | 29 | 0.5 |
| P4 | Abundant | 39 | 0.65 |

Depending on the formulation used, the foam obtained varies in abundance, but the rinsing operations all offer savings in terms of water and reduced time, especially less than one minute.

The invention claimed is:

1. A hair treatment system, comprising:

a pipe for circulating a liquid, a device for feeding the pipe with water, at least one source of product, the product comprising one or more surfactants, a device for injecting product into the pipe to form a treatment solution comprising one or more surfactants in a content ranging from 0.35% to 1.5% by weight of surfactant(s) relative to the total weight of the treatment solution, and a dispensing device for delivering the treatment solution onto the head of hair with a flow rate of between 0.5 and 5 L/min, the dispensing device being a shower head connected to a flexible hose, and the dispensing device comprising nozzles arranged so as to cause two jets leaving the dispensing device to collide before contacting a user while the dispensing device is in use.

2. The hair treatment system according to claim 1, wherein the surfactant(s) are present in the treatment solution in an amount ranging from 0.6% to 1.2% by weight relative to the total weight of the treatment solution.

3. The hair treatment system according to claim 1, wherein the water hardness being less than or equal to 45° f.

4. The hair treatment system according to claim 1, wherein the surfactant(s) are chosen from anionic surfactants, amphoteric surfactants, nonionic surfactants and mixtures thereof.

5. The hair treatment system according to claim 1, wherein the treatment solution comprising one or more anionic surfactants in a content ranging from 0.25% to 1% by weight relative to the total weight of the treatment solution.

6. The hair treatment system according to claim 1, wherein the product injection device injecting between 2.5 g/minute and 20 g/minute of anionic surfactants into the pipe.

7. The hair treatment system according to claim 1, further comprising a pressure booster to increase the pressure of the water entering the dispensing device above the pressure of the water entering the system.

8. The hair treatment system according to claim 1, further comprising a member for controlling the amount of water dispensed, and/or the amount of product injected into the water and/or the flow rate of liquid delivered by the dispensing device.

9. The hair treatment system according to claim 1, further comprising a user interface for selecting a setting, the hair treatment system being configured to act on an adjustment device for varying the content of product as a function of the selected setting, and/or to input at least one item of information relating to a treatment result obtained with the selected setting.

10. The hair treatment according to claim 1, further comprising a means for memorizing at least one setting by associating it with a person and/or a person's identification code.

11. A washing system comprising:

a pipe for circulating a liquid, a device for feeding the pipe with water, at least one source of product, the product comprising one or more surfactants, a device for injecting product into the pipe to form a treatment solution comprising one or more surfactants in a content ranging from 0.35% to 1.5% by weight relative to the total weight of the treatment solution, and a dispensing device for delivering the treatment solution with a flow rate of between 0.5 and 5 L/min, the dispensing device being a shower head connected to a flexible hose, and the dispensing device comprising nozzles arranged so as to cause two jets leaving the dispensing device to collide before contacting a user while the dispensing device is in use.

12. A washing process, comprising the treatment step consisting in spraying the head of hair with a treatment solution comprising water and one or more surfactants at a flow rate of between 0.5 and 5 L/minute, the treatment solution comprising one or more surfactants in a content ranging from 0.35% to 1.5% by weight of surfactant(s) relative to the total weight of the treatment solution, wherein the process is performed using the system according to claim 1.

13. The washing process according to claim 12, wherein the treatment step lasts between 1 and 30 seconds.

14. The washing process according to claim 12, further comprising a step of rinsing the head of hair with a rinsing solution after the treatment step.

15. The washing process according to claim 14, wherein the rinsing solution is water.

16. The washing process according to claim 14, wherein the rinsing step lasts less than 1 minute.

* * * * *